United States Patent [19]

Munro et al.

[11] 4,197,184

[45] Apr. 8, 1980

[54] HYDROREFINING AND HYDROCRACKING OF HEAVY CHARGE STOCK

[75] Inventors: William H. Munro, Lincolnshire; Hong-Kyu Jo, Des Plaines, both of Ill.

[73] Assignee: UOP Inc., Des Plaines, Ill.

[21] Appl. No.: 933,008

[22] Filed: Aug. 11, 1978

[51] Int. Cl.[2] ..... C10G 23/02

[52] U.S. Cl. ..... 208/89

[58] Field of Search ..... 208/89

[56] References Cited

U.S. PATENT DOCUMENTS

| | | | |
|---|---|---|---|
| 3,105,811 | 10/1963 | Engel | 208/89 |
| 3,256,178 | 6/1966 | Hass et al. | 208/89 |
| 3,468,788 | 9/1969 | Wilkinson | 208/89 |
| 3,528,908 | 9/1970 | Bowles et al. | 208/89 |
| 3,535,226 | 10/1970 | Jaffe | 208/89 |
| 3,537,977 | 11/1970 | Smith, Jr. | 280/89 |
| 3,546,094 | 12/1970 | Jaffe | 208/89 |
| 3,617,501 | 11/1971 | Eng et al. | 208/89 |

*Primary Examiner*—George Crasanakis

*Attorney, Agent, or Firm*—James R. Hoatson, Jr.; Robert W. Welch; William H. Page, II

[57] ABSTRACT

A multiple-stage process for the conversion of a heavy hydrocarbonaceous charge stock, contaminated by the inclusion of sulfurous and nitrogenous compounds, into lower-boiling hydrocarbon products. Fresh feed and hydrogen are introduced into a catalytic hydrorefining reaction zone to convert the contaminants into ammonia and hydrogen sulfide. Hydrorefined product effluent is admixed with the effluent from a catalytic hydrocracking reaction zone, and separated into various product streams. Hydrocarbons boiling above the predetermined end boiling point of the desired end product and hydrogen are introduced into the catalytic hydrocracking reaction zone for conversion to lower-boiling hydrocarbons. Hydrocracked effluent is admixed with the hydrorefined effluent as aforesaid.

7 Claims, 1 Drawing Figure

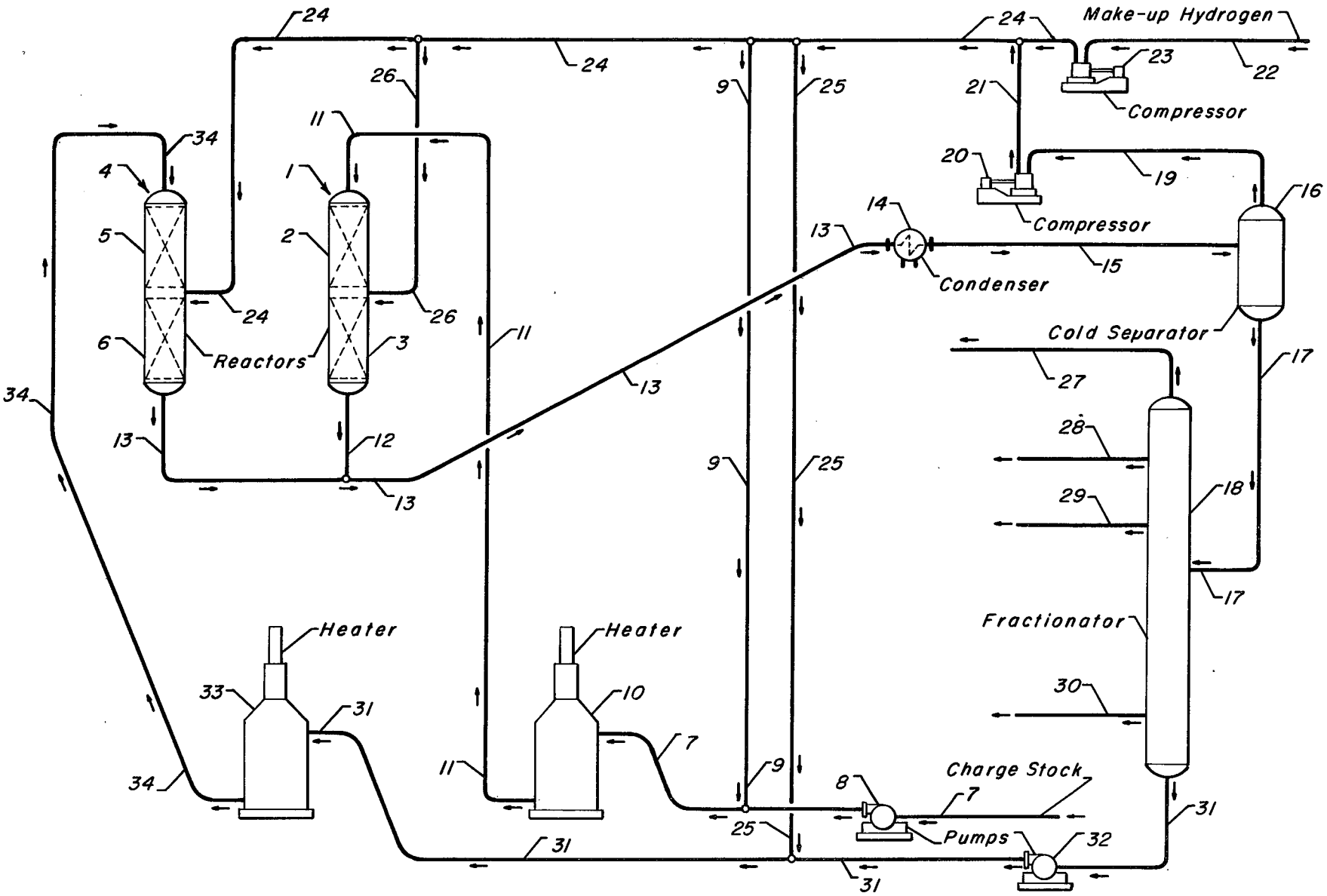
Make-up Hydrogen
Compressor
Compressor
Condenser
Cold Separator
Fractionator
Charge Stock
Pumps
Heater
Heater
Reactors

HYDROREFINING AND HYDROCRACKING OF HEAVY CHARGE STOCK

APPLICABILITY OF INVENTION

As herein described, the present invention is directed toward the multiple-stage, selective hydrocracking of contaminated, heavier-than-gasoline boiling range charge stocks. The specific intent is to produce maximum volumetric yields of lower-boiling, normally liquid hydrocarbons having a predetermined end boiling point. Selective hydrocracking is particularly important when processing hydrocarbons and mixtures of hydrocarbons which boil at temperatures above the middle distillate boiling range; that is, hydrocarbons and mixtures of hydrocarbons having a boiling range indicating an initial boiling point of about 650° F. (343.3° C.) and an end boiling point as high as about 1050° F. (565.6° C.). Selective hydrocracking of such hydrocarbon fractions results in greater yields of hydrocarbons boiling within and below the middle distillate boiling range. Additionally, selective hydrocracking results in increased yields of gasoline boiling range hydrocarbons; that is, those boiling within the range of about 100° F. (37.8° C.) to about 400° F. (204.4° C.).

Suitable charge stocks to the present combination hydrorefining/hydrocracking process include kerosene fractions, light and heavy gas oil fractions, lubricating oil and white oil stocks, cycle stocks, the various high-boiling bottoms recovered from the fractionators generally accompanying catalytic cracking operations and referred to as heavy recycle stock, and other sources of hydrocarbons which have a depreciated market demand due to high boiling points and the presence of various contaminating influences including nitrogenous compounds and sulfurous compounds. Additionally, the present process affords the utilization of hydrocarbonaceous material containing metallic contaminants as well as asphaltenic material; such fractions are commonly referred to in the petroleum refining art as "black oils". These egregious feedstocks are further characterized in that at least about 10.0% by volume boils above a temperature of about 1050° F. (565.6° C.).

The flexibility of the present process is dependent to a large extent upon the boiling range of the available feedstock. That is, flexibility increases as the end boiling point of the charge stock increases. For example, where the feedstock contains hydrocarbons boiling from about 400° F. (204.4° C.) to about 650° F. (343.3° C.), the desired product generally constitutes gasoline boiling range hydrocarbons. As hereinafter indicated in a specific illustration, in which the charge stock is a heavy gas oil having an initial boiling point of about 660° F. (348.9° C.) and an end boiling point of about 940° F. (504.4° C.), the process can be effected to result in diverse desired products such as a diesel fuel having an initial boiling point of about 356° F. (180° C.) and an end boiling point of about 645° F. (340.6° C.), or a jet fuel having an initial boiling point of about 330° F. (165.6° C.) and an end boiling point of about 550° F. (287.8° C.).

OBJECTS AND EMBODIMENTS

A principal object of the present invention is to provide a multiple-stage process for converting high-boiling hydrocarbonaceous charge stocks into lower-boiling, normally liquid hydrocarbon products. A corollary objective is to afford a process which enhances flexibility with respect to the primary desired product.

A specific object of our invention directs itself to providing a process of lower initial investment cost, lower daily operating cost and ease of overall operation.

These, as well as other objects are accomplished in one embodiment directed toward a process for the production of a hydrocarbon fraction having a predetermined end boiling point from a charge stock (1) containing sulfurous and nitrogenous compounds; and, (2) having an end boiling point above said predetermined boiling point, which process comprises the sequential steps of: (a) reacting said charge stock and hydrogen, in a first catalytic reaction zone, at conditions selected to convert sulfurous and nitrogenous compounds to hydrogen sulfide and ammonia; (b) commingling the resulting first reaction zone effluent with effluent from a second catalytic reaction zone; (c) separating the resulting mixture to (i) remove hydrogen sulfide and ammonia; (ii) recover a hydrogen-rich gaseous phase; (iii) recover said hydrocarbon fraction having said predetermined end boiling point; and, (iv) provide a liquid phase containing hydrocarbons boiling above said predetermined end boiling point; (d) reacting said liquid phase and hydrogen, in a second catalytic reaction zone, at conditions selected to convert said liquid phase into lower-boiling hydrocarbons; and, (e) commingling at least a portion of the resulting second reaction zone effluent with said first reaction zone effluent.

In another embodiment, a portion of the hydrogen-rich gaseous phase is recycled to each of said first and second catalytic reacton zones.

Other embodiments involve the utilization of particular operating conditions and catalytic composites. These will become evident from the following more detailed description of the process which is encompassed by our inventive concept.

CITATION OF RELEVANT PRIOR ART

Candor compels recognition and acknowledgment that the prior art proliferates in a wide spectrum of hydrorefining/hydrocracking combination processes for the conversion of contaminated, high-boiling hydrocarbonaceous material into lower-boiling, normally liquid hydrocarbons which are substantially contaminant-free. Perusal of the appropriate Patent Office Classifications 208-55, 208-59, 208-68 and 208-89 indicates that such is the case. No attempt will be made herein to delineate exhaustively the appropriate published literature; it will suffice simply to note several examples which appear to be exemplary of various prior art practices and which are relevant to the invention herein described.

Prior to discussing the five references delineated below, a brief description of the present process is warranted for the purpose of highlighting its distinguishing features. Although certain operating conditions and catalytic composites are preferred for use in the present process, neither constitutes an essential feature of the present process. The novel flow system herein described does, however, afford greater latitude in the type of catalyst and ranges of operating conditions as dictated by the character of the charge stock. Thus, greater flexibility with respect to the product slate is made available without the necessity for catalyst change. In accordance with the present invention, the fresh feed charge stock is admixed with hydrogen and introduced into the hydrorefining reaction zone; no portion of the hydrocracked effluent is passed into the so-called "clean-up" zone. However, the hydrorefined effluent, including normally vaporous components, is commingled with the hydrocracked effluent and subjected to suitable separation facilities. Hydrocarbons boiling beyond the predetermined end point of the desired product form the feed to the hydrocracking reaction zone; none of the hydrorefined product effluent is introduced directly into this latter zone.

U.S. Pat. No. 3,008,895 (Cl. 208-68), issued to Hansford et al on Nov. 14, 1961, involves a multiple-zone process for the conversion of a gas oil fraction into gasoline boiling range hydrocarbons. Involved are either catalytic cracking, or a coking unit, hydrorefining, hydrocracking and catalytic reforming. Considering only the relationship between the hydrorefining and hydrocracking systems, the total hydrorefined product effluent is introduced into the hydrocracking reaction zone. Hydrocracked product effluent boiling above the gasoline boiling range is recycled to the hydrorefining reaction zone. Each of these two systems employs separate separation facilities to recover gasoline boiling range hydrocarbons which are subsequently introduced into the catalytic reforming reaction zone. Furthermore, each employs its own separate hydrogen circulation system. Suitable catalysts for utilization in the hydrorefining zone, containing metal components from Group VI-B and VIII, are discussed in Column 4, Lines 33–59. Catalysts for utilization in the hydrocracking zone, containing metal components from Groups V-B, VI-B, VII-B and VIII, are disclosed in Column 5, Lines 15–55.

A three-stage hydrocracking process is discussed in U.S. Pat. No. 3,026,260, issued to Watkins on Mar. 20, 1962. Initially, the charge stock, having a boiling range from about 700° F. (371.1° C.) to about 1000° F. (537.8° C.) is fractionated to recover hydrocarbons boiling below about 800° F. (426.7° C.). Higher boiling material is introduced into a cracking zone which may constitute catalytic cracking, hydrocracking, or thermal cracking. The effluent from this initial zone is fractionated to recover additional hydrocarbons boiling below about 800° F. (426.7° C.), and the heavier boiling material is recycled to the cracking zone.

The recovered lower-boiling hydrocarbons are introduced into the hydrorefining, or clean-up zone, the effluent from which is introduced into a high-pressure, cold separator for the removal of propane and other normally gaseous components. The remainder is introduced into the hydrocracking reaction zone, the effluent from which is introduced into another high-pressure cold separator for the removal of propane and lighter normally gaseous components. The hydrocracked product effluent is then fractionated to provide a gasoline boiling range fraction having an end boiling point of about 400° F. (204.4° C.) and a middle distillate fraction having an end point of about 650° F. (343.3° C.). The heavier material is then recycled to the hydrocracking reaction zone. With the exception of the propane and lighter vaporous material, it should be noted that the entire hydrorefined product effluent is introduced into the hydrocracking reaction zone. Further, since the process involves two individual high-pressure cold separators, it would appear that two separate recycle hydrogen circuits are necessitated. Suggested operating conditions and catalytic composites for the hydrorefining zone are discussed in Column 12, Lines 3–51, while those for the hydrocracking reaction zone are indicated in Column 13, Lines 1–60.

U.S. Pat. No. 3,072,560 (Cl. 208-55), issued to Paterson et al, on Jan. 8, 1963, is similar to the previously described U.S. Pat. No. 3,008,895. Here, however, all of the normally liquid product effluent from the hydrorefining reaction zone is introduced into the hydrocracking reaction zone, the liquid effluent from which is introduced into a catalytic reforming reaction zone. That is, there is no recovery of gasoline boiling range hydrocarbons from the hydrorefined product effluent. As indicated in the drawing, the process requires three gas-liquid separators (30, 40 and 58) for the purpose of recovering the hydrogen-rich recycle vaporous phase. Catalysts suitable for utilization in the hydrorefining reaction zone are discussed in Column 5, Lines 38–58. A more detailed description of catalysts for utilization in the hydrocracking reaction zone is found at Column 6, Line 7 through Column 8, Line 66.

In U.S. Pat. No. 3,328,290 (Cl. 208-89), issued to Hengstebeck on June 27, 1967, a process for producing predominately gasoline boiling range hydrocarbons from high-boiling hydrocarbon feedstocks is described. The fresh feed, in admixture with all of the hydrocracked product effluent is introduced into the hydrorefining reaction zone. A separation facility is utilized to recover a hydrogen-rich gaseous phase, the desired product and unconverted hydrocarbons boiling beyond the gasoline boiling range. The latter, in admixture with all of the recovered hydrogen and make-up hydrogen, is introduced into the hydrocracking reaction zone. Operating conditions and suitable catalytic composites for both the hydrorefining and hydrocracking reaction zones are disclosed from Column 3, Line 34 through Column 4, Line 67.

In U.S. Pat. No. 3,472,758 (Cl. 208-59), issued to Stine et al on Oct. 14, 1969, a two-stage process is described for the maximization of gasoline boiling range hydrocarbons having an end boiling point of about 400° F. (204.4° C.). The fresh feed charge stock is introduced into the hydrorefining reaction zone in admixture with the entire product effluent from the hydrocracking reaction zone. The mixture is separated to recover a hydrogen-rich recycle gaseous phase which is introduced in total into the hydrocracking reaction zone. Normally liquid hydrocarbons are separated to provide the desired gasoline boiling range fraction, a middle-distillate fraction having an end boiling point of about 650° F. (343.3° C.) and a heavy recycle fraction boiling above 650° F. (343.3° C.). The light, middle-distillate recycle is introduced into the hydrocracking reaction zone, while the heavy recycle is admixed with the fresh feed charge stock and introduced into the hydrorefining reaction zone. Hydrorefining catalysts and operating conditions are described in Column 7, Lines 14–51. Those utilized in the hydrocracking reaction zone are described from Column 8, Line 49 through Column 9, Line 38.

A perusal of the foregoing, copies of which accompany this application, indicates that the process techniques of the present invention are not recognized. Either all of the hydrorefining reaction zone effluent is introduced into the hydrocracking reaction zone, or the effluent from the latter is employed to dilute the fresh feed charge stock to the former.

SUMMARY OF INVENTION

Hydrorefining/hydrocracking processes of the prior art, where either (1) the hydrocracked effluent is introduced into the hydrorefining zone to dilute the fresh feed charge stock, or (2) the hydrorefined effluent (usually, but not always, with ammonia and hydrogen sulfide removed) passes into the hydrocracking zone, are categorized in petroleum refining technology as "series-flow" systems. Our process constitutes a modified "parallel-flow" technique in that each reaction system functions independently of the other with the product effluents being admixed for cojoint separation in a single separation facility. That is, the parallel-flow system utilizes a common recycle hydrogen compressor, a single product condenser and a single high-pressure, cold separator. The charge to the hydrocracking reaction system can be any combination of distillates, recovered from the common separation facility, required to attain the desired product slate.

Many other advantages are attainable through the use of the parallel-flow process herein described. These involve design considerations, operational aspects (particularly stability) and economic enhancements. Thus, each reactor circuit can be designed to increase thermal efficiency; as an example, for a combination unit having a vacuum gas oil charge rate of about 60,000 Bbl/day (9,540 $M^3$/day), the direct-fired heater duty (generally calculated as BTU/hour) in the parallel-flow system decreases by approximately 16.7%. In large units of this nature, this can amount to about 30 million BTU/hour. In an energy-conscious society, this figure attains significant proportions. Flexibility respecting product slate is enhanced by virtue of the fact that the lower boiling hydrocarbons resulting from the hydrocracking effected in the hydrorefining reaction zone are not introduced into the hydrocracking zone. As hereinafter described, and as illustrated in the accompanying drawing, the present process splits the recycled hydrogen stream such that separate portions are introduced into each of the two reaction systems. This technique further adds to the stability of the overall process operation and facilitates catalyst regeneration when such becomes necessary. Catalyst stability at the desired degree of activity is enhanced by virtue of the fact that the hydrocracked effluent is not introduced into the hydrorefining reaction zone and the effluent from the latter is not introduced into the former. Control of catalyst bed temperature is independent in both systems which reduces the opportunities for temperature runaway. Reduced mass velocity permits the use of fewer reactor trains which lowers capital investment costs. Other advantages attendant the present parallel-flow combination process will become apparent to those possessing the requisite skill in the petroleum refining art.

As previously stated, the charge stocks to the present combination process will predominate in hydrocarbons boiling from about 600° F. (315.6° C.) to about 1000° F. (537.8° C.), and will contain large percentages of sulfurous and nitrogeneous compounds. For instance, in the illustrative example hereinafter presented, the charge stock has an initial boiling point of 610° F. (321.1° C.) and an end boiling point of 980° F. (526.7° C.), and contains 2.0% by weight of sulfur and about 1,300 ppm. by weight of nitrogen. This type of charge stock must be first processed at operating conditions (including the catalytic composite) which foster the removal of sulfur and nitrogen, while simultaneously converting 650° F.-plus (343.3° C.) material into lower-boiling hydrocarbons. Operating conditions, as indicated in the prior art, will generally be determined by the physical and chemical characteristics of the particular feed being processed. They will, however be such that pressures are in the range of 500 psig. (35.04 atm.) to 2,800 psig. (191.6 atm.), catalyst bed temperatures are about 600° F. (315.6° C.) to about 900° F. (482.2° C.), liquid hourly space velocities range from 0.2 to about 10.0, and hydrogen is admixed with the feed in the amount of about 3,000 to about 10,000 standard cubic feet per barrel (534 to 1780 $M^3/M^3$), of fresh feed.

Suitable hydrorefining catalytic composites contain at least one metal component from the Group VI-B metals, chromium, molybdenum and tungsten, and at least one metallic component from the iron-group metals of Group VIII, iron, nickel and cobalt. These will be composited with a refractory inorganic oxide carrier material, generally amorphous, in amounts such that the iron-group metal is present in an amount of about 0.2% to about 6.0% by weight and the Group VI-B metal is in the amount of about 4.0% to about 40.0% by weight, which amounts are calculated on an elemental basis. Although many prior art processes indicate a preference for alumina as the sole refractory carrier material, we prefer to include another inorganic metal oxide having acidic, or hydrocracking propensities. Thus, it is preferred herein to utilize an amorphous refractory carrier of 60.0% to 90.0% by weight of alumina and 10.0% to about 40.0% by weight of silica.

Catalytic composites and operating conditions in the hydrocracking reaction system are similar to those employed for effecting the necessary hydrorefining reactions. However, the catalyst may include at least one Group VIII noble metal component, and the carrier material may be either amorphous, or zeolitic in nature. Group VI-B metals will be present in amounts within the range of about 0.5% to about 10.0% by weight, and include chromium, molybdenum and tungsten. Group VIII metals may be divided into two sub-groups, and are present in amounts of about 0.1% to about 10.0% by weight of the total catalyst. When an iron-group metal is employed, it is incorporated in amounts from 0.2% to 10.0% by weight. Noble metals, such as platinum, palladium, iridium, rhodium, ruthenium and osmium, will be present in amounts of 0.1% to about 4.0% by weight. Whether amorphous or zeolitic, preferred carrier materials include both alumina and silica. Good results have been obtained with amorphous silica-alumina composites containing 88.0% by weight of silica and 12.0% by weight of alumina, 75.0% by weight of silica and 25.0% by weight of alumina, and 88.0% by weight of alumina and 12.0% by weight of silica. With the relatively heavier hydrocarbonaceous feedstocks, it is often more appropriate to utilize a hydrocracking catalyst founded upon a crystalline aluminosilicate, or zeolitic molecular sieve. Such zeolitic material includes mordenite, Type X or Type Y faujasite, Type A or Type U molecular sieves, etc., and these may be employed in a substantially pure state. However, the zeolitic material may be included within an amorphous matrix such as alumina, silica and mixtures thereof.

Hydrocracking pressures will be approximately the same as those imposed upon the hydrorefining reaction system; that is, about 500 psig (35.04 atm.) to about 2,800 psig. (191.6 atm.). Hydrogen will be admixed with the charge in the amount of about 3,000 to about 10,000 scf/Bbl (534–1780 $M^3/M^3$), and the liquid hourly space velocity will range from about 1.0 to about 15.0. Catalyst bed temperatures will be in the same range as those in the hydrorefining system; however, they will normally be at least about 25° F. (14° C.) lower. Both catalytic reaction systems comprise multiple-zone chambers to facilitate the introduction of an intermediate quench stream to offset the exothermicity of the reactions being effected. With respect to the hydrorefining system, the maximum temperature differential between the inlet and outlet is controlled at about 100° F. (56° C.); for the hydrocracking reaction system, the maximum temperature differential is about 50° F. (28° C.)

BRIEF DESCRIPTION OF DRAWING

Further description of the combination process encompassed by our inventive concept will be made with reference to the accompanying drawing. In the drawing, the process is illustrated by way of a simplified diagrammatic flow scheme; it will be noted that only the major vessels and auxiliary equipment are shown. These are believed sufficient to provide a concise illustration and a clear understanding. For instance, fractionator 18 is intended to be representative of an entire separation facility, complete with multiple columns, reboilers, overhead condensers and reflux pumps, for the recovery of a plurality of product streams indicated as being withdrawn via conduits 27, 28, 29, 30 and 31. The reaction systems are shown as hydrorefining reactor 1, having two individual catalyst beds 2 and 3, and as hydrocracking reactor 4, having two individual catalyst beds 5 and 6. The divided catalyst beds facilitate the introduction of quench streams via conduits 26 and 24, respectively. Other details have been reduced in number, or completely eliminated as being non-essential to an understanding of the techniques which are involved. Utilization of such miscellaneous appurtenances, to modify the process as illustrated, is well within the purview of one skilled in the appropriate art, and will not remove the resulting process beyond the scope and spirit of the appended claims.

DETAILED DESCRIPTION OF DRAWING

With specific reference now to the accompanying drawing, the same will be described in conjunction with a commercially-scaled unit designed to process upwards of 65,000 Bbl/day (10,335 $M^3$/day) of a full boiling range gas oil obtained from an atmospheric crude and vacuum process unit. In this particular illustration, the intent is to maximize the production of a 365° F. to 645° F. (180° C. to 340.6° C.) diesel fuel. The fresh feed charge stock has a gravity of 21.5 °API at 60° F. (15.6° C.), and an initial boiling point of 610° F. (321.1° C.), a 50.0% volumetric distillation temperature of 780° F. (415.6° C.) and an end boiling point of about 980° F. (526.7° C.). The pour point is 77° F. (25° C.), and the contaminants include 2.0% by weight of sulfurous compounds, as elemental sulfur, and about 1,250 ppm. by weight of nitrogenous compounds, as elemental nitrogen. Following temperature increase via indirect contact with hotter process streams—e.g. reaction zone product effluent—the charge stock, in the amount of about 62,400 Bbl/day (9,921.6 $M^3$/day), is introduced into the process by way of conduit 7. Pump 8 raises the pressure to a level of about 1,700 psig. (116.72 atm.); after being admixed with a recycled hydrogen-rich stream from line 9, in the amount of about 8,500 scf/Bbl (1,513 $M^3/M^3$), the charge stock continues via line 7 into direct-fired heater 10.

Heater 10 further raises the temperature of the recycled hydrogen/charge stock mixture to a level such that the catalyst bed inlet temperature is at the designed level. The heated mixture passes through conduit 11 into hydrorefining reaction zone 1 wherein it contacts catalyst bed 2 at a temperature of about 675° F. (357.2° C.) and a liquid hourly space velocity of about 0.55. Reaction product effluent from catalyst bed 2 is admixed with about 2,500 scf/Bbl (445 $M^3/M^3$) of a hydrogen-rich quench stream in line 26. The quench stream is at a temperature such that the temperature of the product effluent from catalyst bed 3, withdrawn via conduit 12, does not exceed a level of about 775° F. (412.8° C.). Hydrorefining reaction system 1 contains a catalytic composite of about 1.9% by weight of nickel and 14.0% by weight of molybdenum, combined with an amorphous carrier material of about 28.4% by weight of silica and 71.6% by weight of alumina.

The hydrorefined product effluent in line 12 is admixed with the product effluent from hydrocracking reaction system 4 in line 13, the mixture continuing therethrough into condenser 14. Prior to entering condenser 14, the product effluent is first used as a heat-exchange medium (in a hot-oil belt) to raise the temperature of other process streams such as the feed to fractionation facility 18. Condenser 14 lowers the temperature of the total reaction product effluent to a level in the range of about 60° F. (15.6° C.) to about 140° F. (60° C.)—e.g. 110° F. (43.3° C.)—the the cooled effluent is introduced into cold separator 16 by way of conduit 15. Normally liquid hydrocarbons and absorbed vaporous material are withdrawn via line 17 and introduced thereby into fractionation facility 18. A hydrogen-rich vaporous phase (about 80.0% by volume), containing some of the lower-boiling entrained liquid components is recovered by way of conduit 19.

The total reaction product effluent in line 13, or line 15, may be treated in any suitable, well-known manner for the removal of ammonia and hydrogen sulfide. For instance, water may be added thereto and cold separator 16 equipped with a water boot; the water removed from the boot will contain substantially all of the ammonia. The vaporous phase in line 19 may be introduced into an amine scrubbing system for the adsorption of the hydrogen sulfide. In any event, these contaminating components will be withdrawn from the process prior to employing any of the vaporous phase in line 19 as recycled hydrogen. Approximately 18,400 scf/Bbl (3,275 $M^3/M^3$) of hydrogen are recovered in line 19 and introduced into recycle compressor 20. Make-up hydrogen (about 95.0%) is introduced via conduit 22 in the amount of about 2200 scf/Bbl (391.6 $M^3/M^3$), and introduced into make-up compressor 23. The recycled hydrogen in line 21 is admixed with the make-up hydrogen in line 24, and continues therethrough in the amount of about 20,600 scf/Bbl (3667 $M^3/M^3$).

Fractionation facility 18 serves to separate the normally liquid product effluent into a plurality of desired product streams. For example, propane and other normally gaseous material will be withdrawn as an overhead stream in line 27, while butanes are recovered via conduit 28. Normally liquid gasoline boiling range hydrocarbons, pentanes to 356° F. (180° C.) are recovered via line 29, and the desired diesel fuel, boiling up to 645° F. (340.6° C.) is recovered through conduit 30. Component analyses of the various streams withdrawn from the illustrated process are consolidated in the following Table I. Included in the Table is the 2.5% by weight of the hydrogen consumed in the overall process, or about 1,540 scf/Bbl (274 $M^3/M^3$). Not included is the hydrogen solution loss of about 660 scf/Bbl (117.5 $M^3/M^3$).

TABLE I

| Component Analyses - Diesel Fuel Production | | |
|---|---|---|
| Component | Wt. % | Vol. % |
| Ammonia | 0.15 | — |
| Hydrogen Sulfide | 2.13 | — |
| Methane | 0.27 | — |
| Ethane | 0.37 | — |
| Propane | 1.40 | — |
| Butanes | 4.71 | 7.61 |
| Pentanes-356° F. | 32.43 | 41.32 |
| 356° F.-645° F. | 61.05 | 67.73 |

About 45,750 Bbl/day (7,274.3 $M^3$/day) of 645° F.-plus material is recovered from separation facility 18 through line 31. After being increased in pressure to about 1700 psig. (116.7 atm.), through the use of pump 32, the heavier material is admixed with 8,800 scf/Bbl (1,566.4 $M^3/M^3$) of the recycled hydrogen diverted from line 24 through line 25. The mixture continues through conduit 31 into direct-fired heater 33 wherein the temperature is increased to a level such that the catalyst bed inlet temperature in hydrocracking reaction system 4 is about 650° F. (343.3° C.), and is introduced thereto through conduit 34. Catalyst beds 5 and 6 have disposed therein a composite of 5.2% by weight of nickel and 2.3% by weight of molybdenum. The carrier material is 75.0% by weight Type Y faujasite, having a silica/alumina ratio of 4.5:1.0, disposed within an alumina matrix. Since the maximum allowable temperature increase is 50° F. (28° C.), the remaining portion of the hydrogen-rich recycle stream in line 24 is utilized, in the amount of about 800 scf/Bbl (142.4 $M^3/M^3$), as the quench stream intermediate catalyst beds 5 and 6. Hydrocracked product effluent, at a temperature of about 700° F. (371.1° C.), is admixed with the hydrorefined effluent in line 12 and introduced therewith into condenser 14 as aforesaid.

By way of illustrating the flexibility of the illustrated process, it will be presumed that marketing considerations dictate the production of a 330° F.-550° F. (165.6° C.-287.8° C.) jet fuel from the same gas oil charge stock. Changed operating conditions include a decrease in operating pressure to 1,500 psig (103.1 atm.) and slightly varying recycle hydrogen and quench rates. Respecting the latter, the hydrogen recycle to hydrocracking reaction system 4 (line 25) is increased to about 9,200 scf/Bbl (1637.6 $M^3/M^3$), and the quench rate (line 24) is increased to about 1,200 scf/Bbl (213.6 $M^3/M^3$. Hydrogen consumption increased slightly to about 2.9% by weight, or 1,765 scf/Bbl (314.2 $M^3/M^3$). Component analyses of the various streams recovered from the process are consolidated in the following Table II:

TABLE II

| Component Analyses - Jet Fuel Production | | |
|---|---|---|
| Component | Wt. % | Vol. % |
| Ammonia | 0.15 | — |
| Hydrogen Sulfide | 2.13 | — |
| Methane | 0.29 | — |
| Ethane | 0.40 | — |
| Propane | 1.80 | — |
| Butanes | 6.76 | 10.94 |
| Pentanes-330° F. | 41.14 | 52.86 |
| 330° F.-550° F. | 50.21 | 56.87 |

The foregoing specification, particularly when read in conjunction with the description of the accompanying drawing, clearly demonstrates the method of effecting the present combination process and the benefits afforded through the utilization thereof.

We claim as our invention:

1. A process for the production of a hydrocarbon fraction having a predetermined end boiling point of from about 100° F. to about 400° F. from a charge stock (1) containing sulfurous and nitrogenous compounds; and (2) possessing an end boiling point of from about 650° F. to about 1050° F., which process comprises:
   (a) reacting said charge stock and hydrogen, in a first catalytic reaction zone, at conditions selected to convert said sulfurous compounds to $H_2S$ and said nitrogenous compounds to $NH_3$ and to form a first reaction zone effluent stream containing said $H_2S$ and $NH_3$;
   (b) commingling directly from said first reaction zone said first reaction zone effluent stream with a second reaction zone effluent stream as herein after delineated to form a first effluent admixture stream;
   (c) cooling said first effluent admixture stream in a condensation zone to reduce the temperature of said first effluent admixture stream to from about 60° F. to about 140° F.;
   (d) separating said cooled first effluent admixture stream in a separation zone to recover a vaporous overhead phase comprising hydrogen, $H_2S$ and $NH_3$ and a liquid hydrocarbon phase including liquid bottoms hydrocarbon fraction, said liquid bottoms hydrocarbon fraction having an end boiling point of from about 100° F. to about 400° F.;
   (e) separating said hydrogen in said vaporous overhead phase of step (d) from said $H_2S$ and $NH_3$ to form a first and second hydrogen recycle stream;
   (f) passing said first hydrogen recycle stream to said first catalytic reaction zone and said second hydrogen stream to said second catalytic reaction zone;
   (g) reacting said liquid bottoms hydrocarbon fraction from step (d) in said second catalytic reaction zone with said second hydrogen recycle stream to convert said liquid bottoms hydrocarbon phase to form said second reaction zone effluent stream; and
   recovering said hydrocarbon fraction having said end boiling point of from about 100° F. to about 400° F. from said liquid hydrocarbon phase of step (d).

2. The process of claim 1 further characterized in that said first reaction zone contains a catalytic composition of at least one Group VI-B metal component and at least one iron-group metal component combined with a refractory inorganic oxide.

3. The process of claim 1 further characterized in that said second reaction zone contains a catalytic composite of at least one Group VIII metal component combined with a refractory metal oxide.

4. The process of claim 2 further characterized in that said catalytic composite comprises a molybdenum component and a nickel component combined with an amorphous composite of alumina and silica.

5. The process of claim 3 further characterized in that said catalytic composite comprises a Group VIII noble metal component.

6. The process of claim 3 further characterized in that said catalytic composite comprises a nickel component and a molybdenum component combined with a crystalline aluminosilicate.

7. The process of claim 1 further characterized in that extrinsic hydrogen is added to either of said first or second hydrogen recycle streams.

* * * * *